US010591848B2

(12) United States Patent
Shima et al.

(10) Patent No.: US 10,591,848 B2
(45) Date of Patent: Mar. 17, 2020

(54) MAGNET ROLLER, DEVELOPING ROLLER, DEVELOPING DEVICE, AND IMAGE FORMING APPARATUS

(71) Applicant: Konica Minolta, Inc., Tokyo (JP)

(72) Inventors: Toshiaki Shima, Sanda (JP); Shinya Tokutake, Okazaki (JP); Hidetoshi Noguchi, Tahara (JP); Hiroaki Umemoto, Neyagawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/183,166

(22) Filed: Nov. 7, 2018

(65) Prior Publication Data

US 2019/0187589 A1 Jun. 20, 2019

(30) Foreign Application Priority Data

Dec. 14, 2017 (JP) ..... 2017-239591

(51) Int. Cl.
*G03G 15/09* (2006.01)

(52) U.S. Cl.
CPC ..... *G03G 15/0921* (2013.01)

(58) Field of Classification Search
None
See application file for complete search history.

(56) References Cited

U.S. PATENT DOCUMENTS 4,604,042 A * 8/1986 Tanigawa ..... B29C 45/0013 264/108
5,065,192 A * 11/1991 Adkins ..... G03G 15/09 399/273
5,227,848 A * 7/1993 Robinson ..... G03G 15/0928 399/272

(Continued)

FOREIGN PATENT DOCUMENTS

JP 10340002 A * 12/1998
JP 2000029316 A * 1/2000

(Continued)

OTHER PUBLICATIONS

Parker, Rollin J., Permanent Magnet Guidelines, Magnetic Materials Producers Association, (Chicago, IL 1988).*
Magnetic Field Basic Relationships (2010).*

*Primary Examiner* — Sevan A Aydin
(74) *Attorney, Agent, or Firm* — Lucas & Mercanti, LLP

(57) ABSTRACT

A magnet roller includes a magnet portion for generating magnetic force such that a plurality of peaks are formed in a magnetic force distribution. The magnet portion includes a plurality of magnetic poles. A cross section of the magnet portion includes a portion in which a distance from an axial center of the magnet portion to an outer edge of the magnet portion continuously changes in the circumferential direction. The magnetic force on a surface of a developing sleeve at a position corresponding to each of the plurality of magnetic poles is determined by (i) a distance from each of the plurality of magnetic poles to the developing sleeve in a (Continued)

radial direction of the developing sleeve and (ii) a magnitude of magnetic force in each of the plurality of magnetic poles. The distances from the plurality of magnetic poles to the developing sleeve in the radial direction are different.

18 Claims, 9 Drawing Sheets

(56) References Cited

U.S. PATENT DOCUMENTS 5,634,182 A * 5/1997 Asanae ..... G03G 13/09 399/267
5,669,051 A * 9/1997 Ochiai ..... G03G 9/10 399/277
5,752,139 A * 5/1998 Sumikawa ..... G03G 15/09 399/264
6,125,255 A * 9/2000 Litman ..... G03G 15/0921 399/276
6,132,634 A * 10/2000 Nishimuro ..... G03G 15/0921 252/62.54
6,343,419 B1 * 2/2002 Litman ..... G03G 15/0921 29/895.21
6,512,908 B2 * 1/2003 Mitamura ..... G03G 15/0921 399/267
6,771,923 B2 * 8/2004 DeYoung ..... G03G 15/0921 399/277
6,990,307 B2 * 1/2006 Dera ..... G03G 15/0921 399/267
2005/0232661 A1 * 10/2005 Murata ..... G03G 15/0921 399/277

FOREIGN PATENT DOCUMENTS

JP 2001312142 A 11/2001
JP 2016153813 A 8/2016

* cited by examiner

FIG.13

UNIT (mT)

| | | EXAMPLE | | COMPARATIVE EXAMPLE 1 | | COMPARATIVE EXAMPLE 2 | |
|---|---|---|---|---|---|---|---|
| | SPECIFICATION VALUE OF MAGNETIC FORCE | MAGNETIC FORCE ON SURFACE OF DEVELOPING SLEEVE | MAGNETIC FORCE OF MAGNETIC POLE IN MAGNET ROLLER | MAGNETIC FORCE ON SURFACE OF DEVELOPING SLEEVE | MAGNETIC FORCE OF MAGNETIC POLE IN MAGNET ROLLER | MAGNETIC FORCE ON SURFACE OF DEVELOPING SLEEVE | MAGNETIC FORCE OF MAGNETIC POLE IN MAGNET ROLLER |
| N1 | 100±5 | 102.0 | 140 | 96.5 | 140 | 103.0 | 140 |
| N2 | 35±5 | 33.5 | 90 | 32.0 | 50 | 32.5 | 50 |
| S1 | −40±5 | 38.5 | 140 | 37.5 | 60 | 37.0 | 60 |
| S2 | −40±5 | 41.0 | 110 | 37.5 | 60 | 39.0 | 80 |
| S3 | −60±5 | 63.0 | 120 | 58.0 | 80 | 58.0 | 90 |

FIG.14

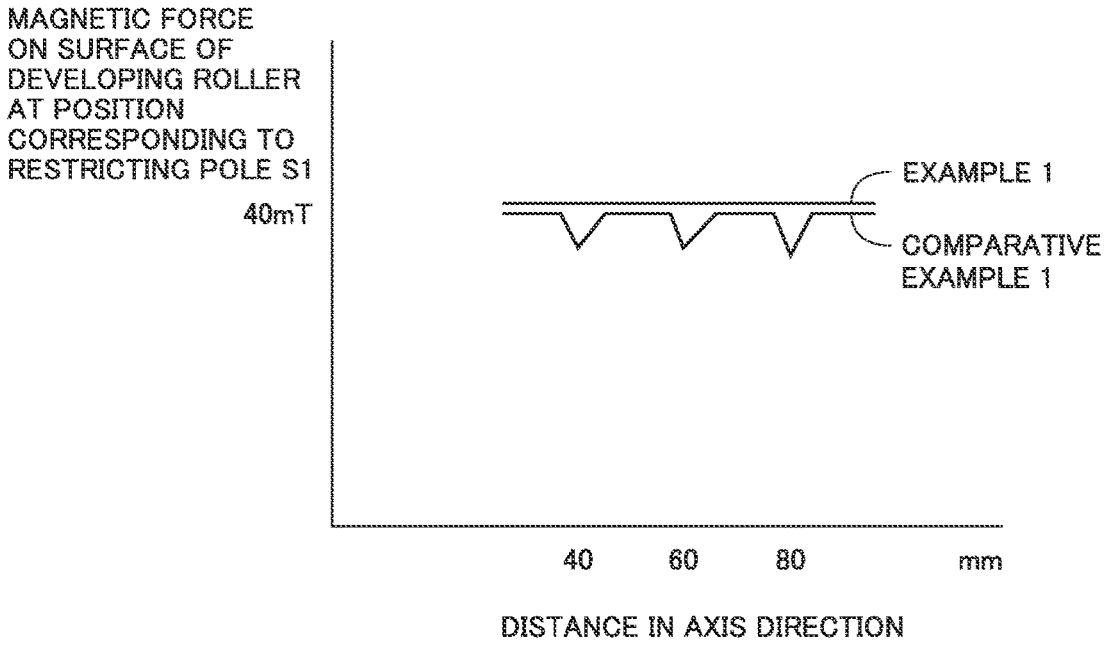

MAGNET ROLLER, DEVELOPING ROLLER, DEVELOPING DEVICE, AND IMAGE FORMING APPARATUS

The entire disclosure of Japanese Patent Application No. 2017-239591, filed on Dec. 14, 2017, is incorporated herein by reference in its entirety.

BACKGROUND

Technological Field

The present disclosure relates to: a magnet roller used for conveyance of toner in an electrophotographic system; a developing roller including the magnet roller; a developing device including the developing roller; and an image forming apparatus including the developing device.

Description of the Related Art

In an image forming apparatus of an electrophotographic system, a developing device supplies a developer to an electrostatic latent image formed on a photoreceptor to form a toner image. The developing device supplies a developer stored in a developer tank to a developing roller by a developer supply member. Then, the developer supplied to the developing roller is supplied to a photoreceptor. The developing roller includes a magnet roller and a cylindrical-shaped developing sleeve that covers the outer circumference of the magnet roller so as to be rotatable.

For example, Japanese Laid-Open Patent Publication Nos. 2001-312142 and 2016-153813 disclose conventional magnet rollers. In the magnet roller disclosed in Japanese Laid-Open Patent Publication No. 2001-312142, a plurality of pillar-shaped variant-type hard magnets each formed of a resin magnet material are combined with each other without having a shaft interposed therebetween. A magnet roller disclosed in Japanese Laid-Open Patent Publication No. 2016-153813 includes a shaft portion and a magnet portion that are integrally molded. The magnet portion includes: a convex portion with a pole having strong magnetic force; and a concave portion formed around the convex portion.

SUMMARY

In the magnet roller disclosed in Japanese Laid-Open Patent Publication No. 2001-312142, the hard magnets are different in shape, so that a complicated magnetic flux density pattern can be readily implemented. Furthermore, each hard magnet can be mono-magnetized.

However, the distance between each of the pillar-shaped hard magnets and the developing sleeve is fixed in the radial direction of the magnet roller. Accordingly, when the magnetic force on the developing sleeve is set at an intermediate value, each hard magnet is magnetized so as to have intermediate magnetic force. In this case, variations occur in the magnetic force of the magnetized magnetic pole, which thereby leads to variations also in magnetic force on the developing sleeve.

In the magnet roller disclosed in Japanese Laid-Open Patent Publication No. 2016-153813, a concave portion is provided around a convex portion serving as a pole having strong magnetic force, so that the magnetic force can be clearly changed between the pole with strong magnetic force and the pole located adjacent thereto.

In the magnet roller disclosed in Japanese Laid-Open Patent Publication No. 2016-153813, however, the variations in magnetic force in the magnetic poles each having a pole magnetized are not sufficiently taken into consideration.

The present disclosure has been made in light of the above-described problems. An object of the present disclosure is to provide a magnet roller, a developing roller, a developing device, and an image forming apparatus, by which variations in magnetic force on a developing sleeve can be suppressed.

To achieve at least one of the above-mentioned objects, according to an aspect of the present invention, a magnet roller reflecting one aspect of the present invention is disposed inside a developing sleeve formed in a cylindrical shape. The magnet roller of the present disclosure includes a magnet portion for generating magnetic force such that a plurality of peaks are formed in a magnetic force distribution in a circumferential direction of the magnet roller. The magnet portion includes a plurality of magnetic poles arranged in the circumferential direction so as to form the plurality of peaks. The magnet portion has a cross section that is orthogonal to an axis direction of the magnet roller. The cross section has a shape formed to include a portion in which a distance from an axial center of the magnet portion to an outer edge of the magnet portion changes continuously in the circumferential direction. Magnetic force on a surface of the developing sleeve at a position corresponding to each of the plurality of magnetic poles is determined by (i) a distance from each of the plurality of magnetic poles to the developing sleeve in a radial direction of the developing sleeve and (ii) a magnitude of magnetic force in each of the plurality of magnetic poles. Distances from the plurality of magnetic poles to the developing sleeve in the radial direction of the developing sleeve are different.

To achieve at least one of the above-mentioned objects, according to an aspect of the present invention, a developing roller reflecting one aspect of the present invention comprises: the magnet roller and the developing sleeve.

To achieve at least one of the above-mentioned objects, according to an aspect of the present invention, a developing device reflecting one aspect of the present invention comprises: the developing roller; and a developer restriction member configured to restrict an amount of a developer carried by the developing roller.

To achieve at least one of the above-mentioned objects, according to an aspect of the present invention, an image forming apparatus reflecting one aspect of the present invention comprises: the developing device; and a transfer unit configured to transfer a toner image developed by the developing device on a recording medium.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 13 is a diagram showing results of Verification Experiment 1 conducted in order to verify the effect of the embodiment.

FIG. 14 is a diagram showing results of Verification Experiment 2 conducted in order to verify the effect of the embodiment.

DETAILED DESCRIPTION OF EMBODIMENTS

Figure 1:
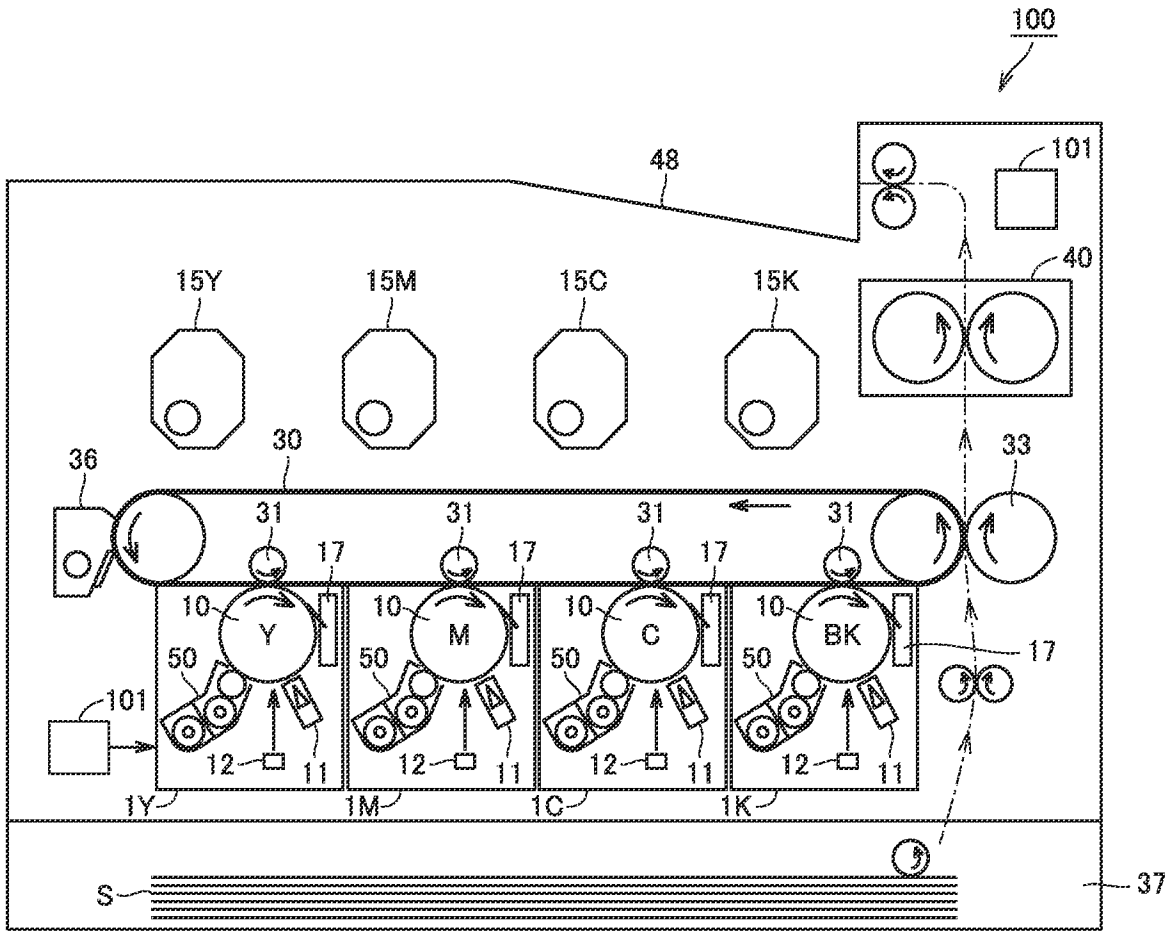
FIG. 1 is a schematic diagram of an image forming apparatus according to an embodiment.

Hereinafter, one or more embodiments of the present invention will be described with reference to the drawings. However, the scope of the invention is not limited to the disclosed embodiments.

In each embodiment described below, the same or corresponding components are designated by the same reference characters in the drawings, and description thereof will not be repeated.

First Embodiment

[Image Forming Apparatus]

FIG. 1 is a schematic diagram of an image forming apparatus. Referring to FIG. 1, an image forming apparatus 100 according to an embodiment will be hereinafter described.

FIG. 1 shows image forming apparatus 100 as a color printer. Although image forming apparatus 100 as a color printer will be described below, image forming apparatus 100 is not limited to a color printer. For example, image forming apparatus 100 may be a monochrome printer, or may be a facsimile machine, or may be a multi-functional peripheral (MFP) including a monochrome printer, a color printer, and a facsimile machine.

Image forming apparatus 100 includes: image forming units 1Y, 1M, 1C, and 1K; an intermediate transfer belt 30, a primary transfer roller 31, a secondary transfer roller 33, a cleaning device 36, a cassette 37, a fixing device 40, and a controller 101.

Image forming unit 1Y receives toner supplied from a toner bottle 15Y to form a toner image of yellow (Y). Image forming unit 1M receives toner supplied from a toner bottle 15M to form a toner image of magenta (M). Image forming unit 1C receives toner supplied from a toner bottle 15C to form a toner image of cyan (C). Image forming unit 1K receives toner supplied from a toner bottle 15K to form a toner image of black (BK).

Image forming units 1Y, 1M, 1C, and 1K are arranged sequentially in the direction in which intermediate transfer belt 30 rotates. Each of image forming units 1Y, 1M, 1C, and 1K includes a photoreceptor 10, a charging device 11, an exposure device 12, a cleaning device 17, and a developing device 50.

Photoreceptor 10 serves as an image carrier that carries a toner image. By way of example, photoreceptor 10 is formed in a drum shape. Photoreceptor 10 has a surface on which a photosensitive layer is formed. Charging device 11 uniformly charges the surface of photoreceptor 10. In response to the control signal from controller 101, exposure device 12 applies a laser beam to photoreceptor 10 to expose the surface of photoreceptor 10 according to the designated image pattern. Thereby, an electrostatic latent image in accordance with an input image is formed on photoreceptor 10. The electrostatic latent image formed on photoreceptor 10 is developed as a toner image by developing device 50. The details of developing device 50 will be described later.

Photoreceptor 10 and intermediate transfer belt 30 come into contact with each other at a portion where primary transfer roller 31 is provided. By transfer bias applied to this contact portion, the toner image developed on photoreceptor 10 is transferred onto intermediate transfer belt 30. At this time, the toner image of yellow (Y), the toner image of magenta (M), the toner image of cyan (C), and the toner image of black (BK) are sequentially stacked on one another and transferred onto intermediate transfer belt 30. Thereby, a color toner image is formed on intermediate transfer belt 30.

Cleaning device 17 includes a cleaning blade. The cleaning blade is pressed into contact with photoreceptor 10 to collect the toner remaining on the surface of photoreceptor 10 onto which the toner image has been transferred.

Sheets of paper S are placed in cassette 37. Sheets of paper S are fed one by one from cassette 37 to secondary transfer roller 33. The toner image transferred onto intermediate transfer belt 30 is transferred by secondary transfer roller 33 onto sheet of paper S. By synchronizing the timing of feeding and conveying sheet of paper S with the position of the toner image on intermediate transfer belt 30, the toner image is transferred at an appropriate position on sheet of paper S. Then, sheet of paper S is conveyed to fixing device 40.

Fixing device 40 pressurizes and heats sheet of paper S. Thereby, the toner image is melted on sheet of paper S and fixed thereonto. Then, sheet of paper S is discharged to tray 48.

Cleaning device 36 includes a cleaning blade. The cleaning blade is pressed into contact with intermediate transfer belt 30 to collect the toner remaining on intermediate transfer belt 30 onto which the toner image has been transferred. The collected toner is conveyed by a conveyance screw (not shown) and stored in a waste toner container (not shown).

Controller 101 controls, for example, a motor (not shown) and the like for driving developing roller 60 (see FIG. 2) in developing device 50 so as to rotate, thereby adjusting the amount of the developer to be supplied from developing device 50 to photoreceptor 10.

The structure of image forming apparatus 100 is not limited to the example shown in FIG. 1. For example, image forming apparatus 100 may be formed of one photoreceptor 10 and a plurality of developing devices 50 each configured to be rotatable. In this case, image forming apparatus 100 causes each developing device 50 to rotate so as to sequentially bring each developing device 50 to reach photoreceptor 10. Thereby, the toner images of their respective colors are developed on photoreceptor 10 to form a color image.

[Developing Device]

Figure 2:
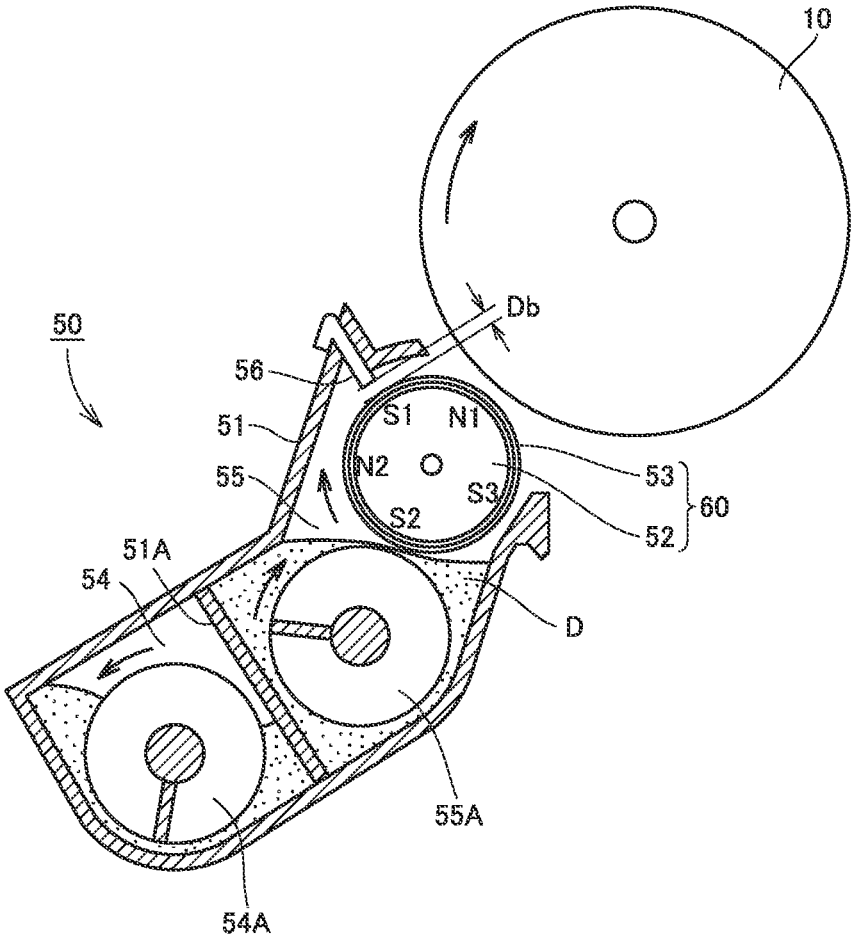
FIG. 2 is a schematic diagram of a developing device according to the embodiment.

FIG. 2 is a schematic diagram of the developing device according to the embodiment. Referring to FIG. 2, developing device 50 according to the embodiment will be hereinafter described.

As shown in FIG. 2, developing device 50 includes a housing 51. Housing 51 is equipped therein with a partition wall 51A, a first stirring member 54A, a second stirring member 55A, and a developing roller 60.

Partition wall 51A is provided in the axis direction of developing roller 60. Housing 51 has an internal space divided by partition wall 51A into a first conveying chamber 54 and a second conveying chamber 55. A developer D is stored in each of first conveying chamber 54 and second conveying chamber 55. Developer D is made of toner and magnetic carriers.

First stirring member 54A is disposed inside first conveying chamber 54. While stirring developer D, first stirring member 54A conveys developer D from first conveying chamber 54 to second conveying chamber 55. Second stirring member 55A is disposed inside second conveying chamber 55. While stirring developer D, second stirring member 55A conveys developer D to developing roller 60. As first stirring member 54A and second stirring member 55A rotate in the directions opposite to each other, developer D is circulated between first conveying chamber 54 and second conveying chamber 55 through circulation ports (not shown) provided at both ends of partition wall 51A.

Developing roller 60 is disposed to face photoreceptor 10 at a prescribed distance from photoreceptor 10. Developing roller 60 includes a magnet roller 52 for attracting developer D, and a cylindrical-shaped developing sleeve 53 provided on the circumference of magnet roller 52 so as to be rotatable. Magnet roller 52 is disposed inside developing sleeve 53.

Housing 51 of developing device 50 is provided with a restriction member 56 for adjusting the amount of developer D to be conveyed. Restriction member 56 has one end fixed to housing 51. Restriction member 56 is formed in a plate shape, for example, and disposed such that its plate surface is orthogonal to the rotation plane of developing sleeve 53. Restriction member 56 is not limited to a plate shape but may be formed in a round bar shape. Restriction member 56 is provided in the axis direction of developing roller 60.

Restriction member 56 is provided so as to face the surface of developing sleeve 53 of developing roller 60. More specifically, restriction member 56 is disposed so as to face a restricting pole 51 (described later) of magnet roller 52 at a distance Db from developing sleeve 53.

It is preferable that restriction member 56 is formed of a magnetic material. Thereby, a magnetic field is formed between restriction member 56 and developing roller 60, so that magnetic attraction force acts on the surface of restriction member 56. Thereby, developer D can more readily be cut by rubbing, so that the layer thickness of developer D can be readily adjusted.

Figure 3:
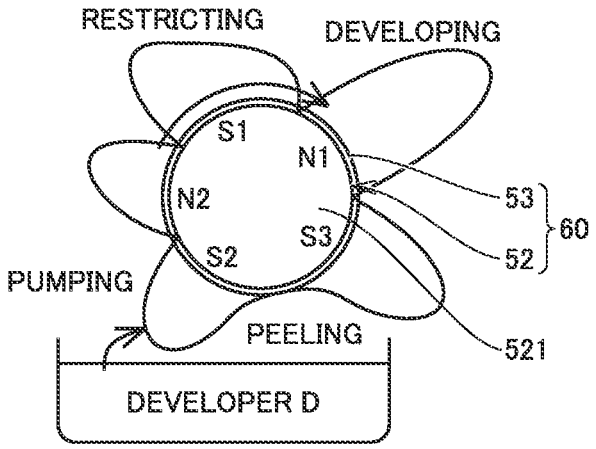
FIG. 3 is a diagram showing a magnetic force distribution of a developing roller according to the embodiment.

FIG. 3 is a diagram showing a magnetic force distribution of the developing roller according to the embodiment. Referring to FIG. 3, the function of developing roller 60 will be hereinafter described.

As shown in FIG. 3, the magnetic force distribution of developing roller 60 exhibits a plurality of peaks that are arranged in the circumferential direction. The magnetic force of developing roller 60 is formed by the magnetic force generated from the magnet portion of the magnet roller, which will be described later. The plurality of peaks are formed by a plurality of magnetic poles of a magnet portion 521 (described later) in magnet roller 52.

The plurality of magnetic poles include a pumping pole S2, a conveying pole N2, a restricting pole S1, a developing pole N1, and a peeling pole S3. Pumping pole S2, conveying pole N2, restricting pole S1, developing pole N1, and peeling pole S3 are arranged sequentially in this order in the direction indicated by an arrow DR1 shown in FIG. 3 (in the circumferential direction of magnet roller 52).

Developer D is stirred to generate static electricity, so that developer D is charged. The charged developer D is attracted to pumping pole S2 so as to adhere to developing sleeve 53. Developer D adhering to developing sleeve 53 is conveyed by conveying pole N2 toward restricting pole S1.

Upon reception of the magnetic force from restricting pole S1, the conveyed developer D is shaped to continuously extend in the vertical direction toward photoreceptor 10 on the surface of developing sleeve 53. Thereby, developer D is cut by rubbing by restriction member 56, so that the uniform amount of developer D is to be conveyed.

After passing through restricting pole S1, developer D is conveyed to developing pole N1. Upon reception of the magnetic force from developing pole N1, developer D is shaped to continuously extend in the direction of magnetic force. In other words, developing pole N1 causes the developer carried by developing sleeve 53 to rise to form a magnetic brush.

The toner that constitutes developer D is charged with positive polarity while the carrier that constitutes developer D is charged with negative polarity. Since the electrostatic latent image formed on photoreceptor 10 is charged with negative polarity, only the toner adheres to photoreceptor 10. Thereby, the electrostatic latent image formed on photoreceptor 10 is developed as a toner image. Then, developer D remaining on developing sleeve 53 is conveyed to peeling pole S3. In developer D conveyed to peeling pole S3, the magnetic field starts to weaken from the latter half of peeling pole S3 and then reaches approximately zero, which continues for some time, with the result that developer D is peeled off from developing sleeve 53.

[Magnet Roller]

Figure 4:
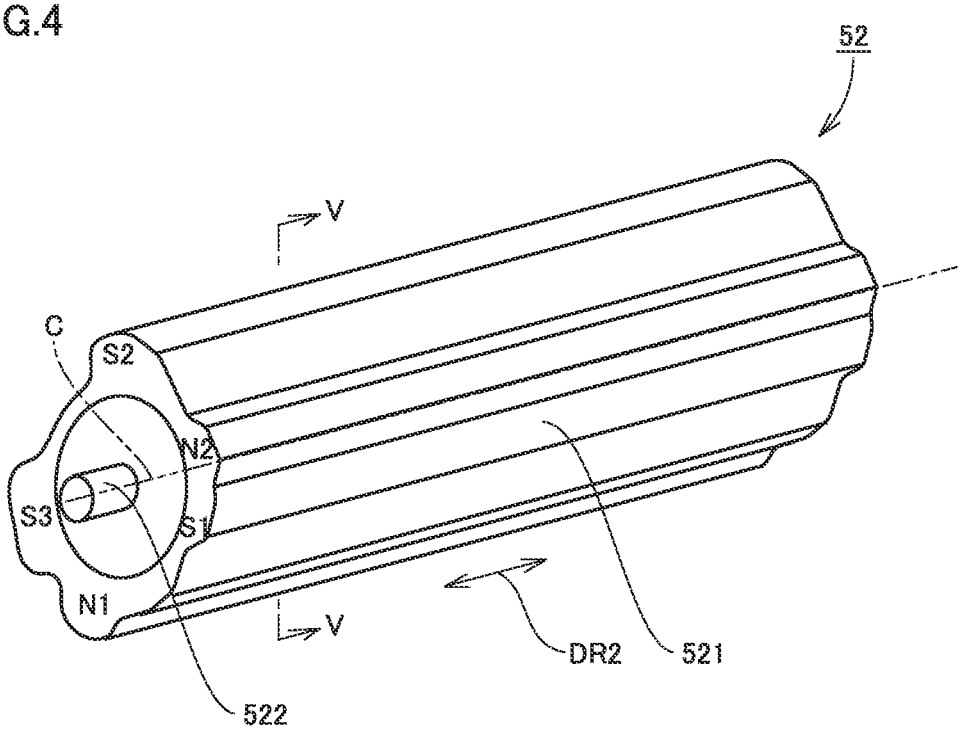
FIG. 4 is a perspective view of a magnet roller according to the embodiment.
Figure 5:
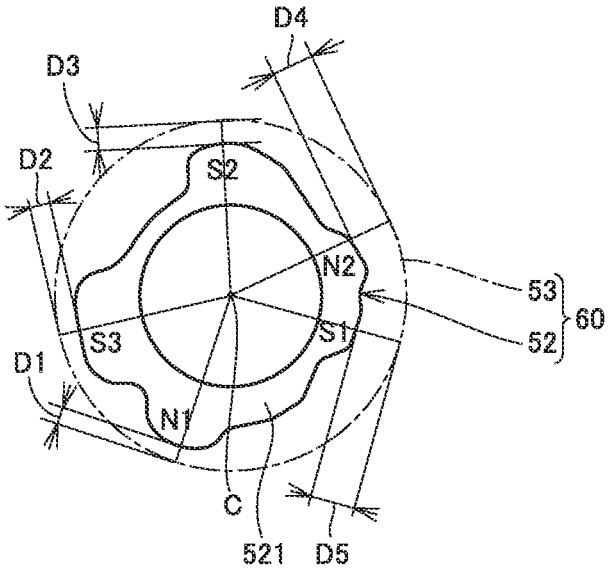
FIG. 5 is a cross-sectional view of the magnet roller according to the embodiment.

FIG. 4 is a perspective view of a magnet roller according to the embodiment. FIG. 5 is a cross-sectional view of the magnet roller according to the embodiment. Referring to FIGS. 4 and 5, the specific structure of the magnet roller according to the embodiment will be described. In FIG. 5, a solid line shows the magnet roller while an alternate long and short dash line shows the developing sleeve.

As shown in FIG. 4, magnet roller 52 includes a magnet portion 521 and a shaft portion 522. Shaft portion 522 protrudes from magnet portion 521 in the axis direction of magnet roller 52 (in a DR2 direction in FIG. 4). The axial center of shaft portion 522 and the axial center of magnet portion 521 approximately coincide with each other.

Magnet portion 521 generates magnetic force such that a plurality of peaks are formed in the magnetic force distribution in the circumferential direction of magnet roller 52. Magnet portion 521 includes the above-described plurality of magnetic poles. The plurality of magnetic poles include a plurality of magnetic poles arranged in the circumferential direction so as to form the plurality of peaks as described above.

As shown in FIG. 5, magnet portion 521 has a cross section that is orthogonal to the axis direction of magnet roller 52. This cross section has a shape formed to include a portion in which the distance from an axial center C of magnet portion 521 to the outer edge of magnet portion 521 continuously changes along the circumferential direction. This cross section of magnet portion 521 has an irregular concavo-convex shape.

The distances from the plurality of magnetic poles to developing sleeve 53 in the radial direction of developing sleeve 53 are different from one another. Specifically, in the above-described radial direction, a distance D3 from pumping pole S2 to developing sleeve 53, a distance D4 from conveying pole N2 to developing sleeve 53, a distance D5 from restricting pole S1 to developing sleeve 53, a distance D1 from developing pole N1 to developing sleeve 53, and a distance D3 from peeling pole S3 to developing sleeve 53 are different from one another.

In the cross-sectional shape of magnet portion 521, a portion of the outer edge of magnet portion 521 that corresponds to developing pole N1 includes a portion located at a maximum distance from axial center C of magnet portion 521. Thereby, the magnetic force and the strength of magnet portion 521 can be ensured.

In the cross-sectional shape of magnet portion 521, a portion of the outer edge of magnet portion 521 that corresponds to peeling pole S3 includes a straight portion. Specifically, a portion of the outer edge of magnet portion 521 that corresponds to peeling pole S3 has a convex shape having a linearly-shaped top portion. This allows a shape formed in accordance with the magnetic force distribution required as peeling pole S3.

Figure 6:
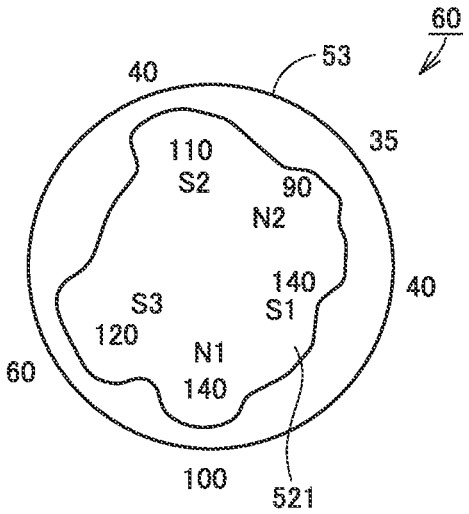
FIG. 6 is a diagram showing: magnetic force in each magnetic pole of a magnet portion according to the embodiment; and magnetic force on a developing sleeve at a position corresponding to each magnetic pole.

FIG. 6 is a diagram showing: magnetic force in each magnetic pole of the magnet roller according to the embodiment; and magnetic force on the developing sleeve at the position corresponding to each magnetic pole.

As shown in FIG. 6, the magnetic force on the surface of developing sleeve 53 at the position corresponding to each of the plurality of magnetic poles is determined by (i) the distance from each magnetic pole to developing sleeve 53 in the radial direction of developing sleeve 53, and (ii) the magnitude of the magnetic force in each magnetic pole.

Pumping pole S2 is magnetized such that the magnetic force is approximately 110 mT in pumping pole S2. In this case, the distance from pumping pole S2 to developing sleeve 53 in the above-described radial direction is set to be D3, so that the magnetic force on the surface of developing sleeve 53 at the position corresponding to pumping pole S2 becomes approximately 40 mT.

Conveying pole N2 is magnetized such that the magnetic force is approximately 90 mT in conveying pole N2. In this case, the distance from conveying pole N2 to developing sleeve 53 in the above-described radial direction is set to be D4, so that the magnetic force on the surface of developing sleeve 53 at the position corresponding to conveying pole N2 becomes approximately 35 mT.

Restricting pole S1 is magnetized such that the magnetic force is 140 mT in restricting pole S1. In this case, the distance from restricting pole S1 to developing sleeve 53 in the above-described radial direction is set to be D5, so that the magnetic force on the surface of developing sleeve 53 at the position corresponding to restricting pole S1 becomes approximately 40 mT.

Developing pole N1 is magnetized such that the magnetic force is approximately 140 mT in developing pole N1. In this case, the distance from developing pole N1 to developing sleeve 53 in the above-described radial direction is set to be D1, so that the magnetic force on the surface of developing sleeve 53 at the position corresponding to developing pole N1 becomes approximately 100 mT.

Peeling pole S3 is magnetized such that the magnetic force is 120 mT in peeling pole S3. In this case, the distance from peeling pole S3 to developing sleeve 53 is set to be D2 in the above-described radial direction, so that the magnetic force on the surface of developing sleeve 53 at the position corresponding to peeling pole S3 becomes as approximately 60 mT.

Figure 7:
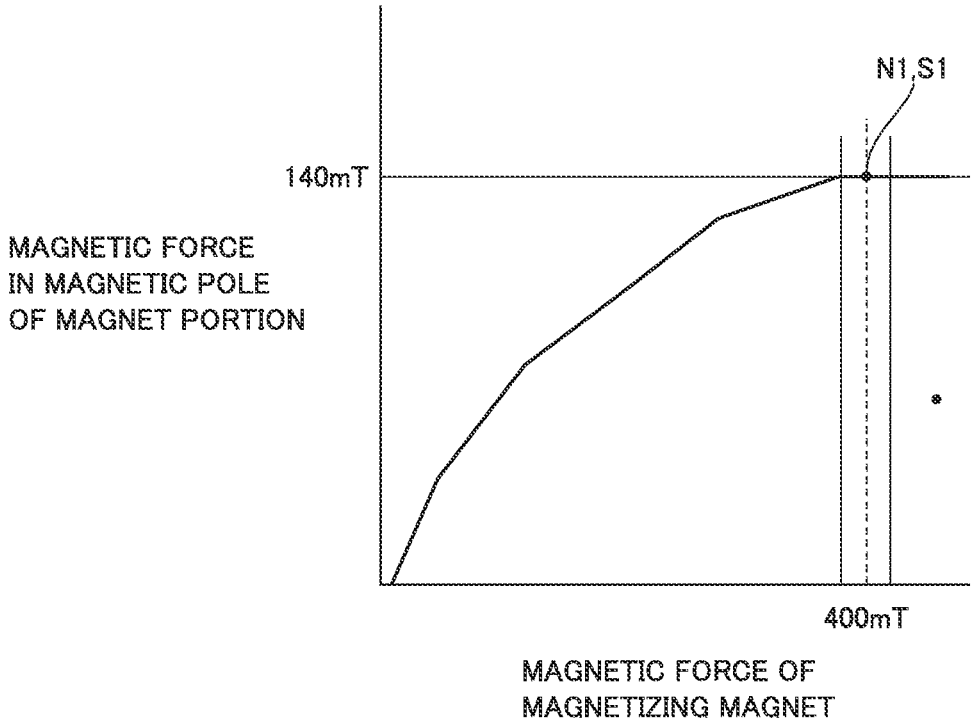
FIG. 7 is a diagram showing: magnetic force of a developing pole and magnetic force of a restricting pole according to the embodiment; and magnetic force of a magnetizing magnet for magnetizing the developing pole and the restricting pole while illustrating the relation between the magnetic force of the magnetizing magnet and the magnetic force in each magnetic pole of the magnet portion magnetized by the magnetizing magnet.

FIG. 7 is a diagram showing: magnetic force of the developing pole and magnetic force of the restricting pole according to the embodiment; and magnetic force of a magnetizing magnet for magnetizing the developing pole and the restricting pole while illustrating the relation between the magnetic force of the magnetizing magnet and the magnetic force in each magnetic pole of the magnet roller magnetized by the magnetizing magnet.

As shown in FIG. 7, the magnetic force in the magnetic pole of magnet portion 521 is displaced so as to become closer to a prescribed value (saturated magnetic force) as the magnetic force of the magnetizing magnet becomes greater. Furthermore, the displacement amount of the magnetic force in the magnetic pole of magnet portion 521 becomes smaller as the magnetic force of the magnetizing magnet becomes greater.

Among the plurality of magnetic poles, developing pole N1 and restricting pole S1 each correspond to a main magnetic pole having maximum magnetic force. Also developing pole N1 and restricting pole S1 are magnetized until the magnetic force is saturated. In other words, the magnetic force of each of developing pole N1 and restricting pole S1 is saturated magnetic force. Thus, it becomes possible to prevent variations in magnetic force of each of developing pole N1 and restricting pole S1 that are magnetized.

The magnetic forces of developing pole N1 and restricting pole S1 may be in the vicinity of their respective saturated magnetic forces, and each are preferably 80% or higher of their respective saturated magnetic forces. When the magnetic force of each of developing pole N1 and restricting pole S1 is magnetized in this way, the displacement of the magnetic force of each of developing pole N1 and restricting pole S1 can be suppressed even if variations occur in the magnetic force of the magnetizing magnet. Thereby, it becomes possible to suppress variations in magnetic force of each of developing pole N1 and restricting pole S1 that are magnetized.

Figure 8:
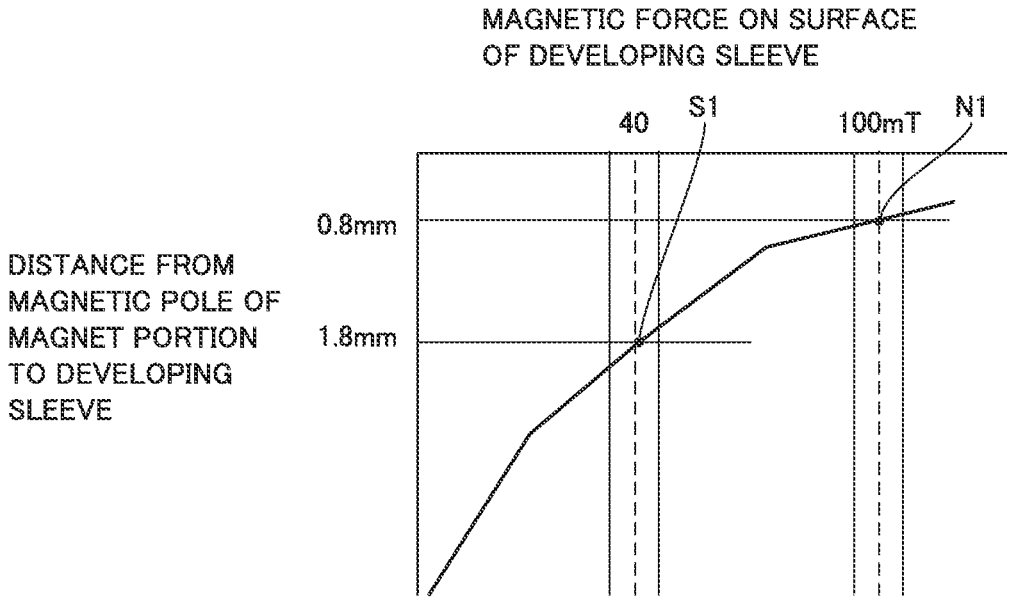
FIG. 8 is a diagram showing magnetic force on the surface of the developing sleeve at the position corresponding to each of the developing pole and the restricting pole according to the embodiment while illustrating the relation between the distance from each magnetic pole of the magnet portion to the developing sleeve and the magnetic force on the surface of the developing sleeve at the position corresponding to each magnetic pole.

FIG. 8 is a diagram showing magnetic force on the surface of the developing sleeve at the position corresponding to each of the developing pole and the restricting pole according to the embodiment while illustrating the relation between the distance from each magnetic pole of the magnet portion to the developing sleeve and the magnetic force on the surface of the developing sleeve at the position corresponding to each magnetic pole.

As shown in FIG. 8, as the distance from each magnetic pole of magnet portion 521 to developing sleeve 53 increases, the magnetic force on the surface of the developing sleeve at the position corresponding to each magnetic pole decreases. In other words, by adjusting the distance from each magnetic pole of magnet portion 521 to developing sleeve 53, the magnetic force on the surface of developing sleeve 53 can be adjusted.

The magnetic forces of developing pole N1 and restricting pole S1 each are 140 mT. In this case, by providing a difference between the distance from developing pole N1 to developing sleeve 53 and the distance from restricting pole S1 to developing sleeve 53, the magnetic force on the surface of developing sleeve 53 at the position corresponding to developing pole N1 and the magnetic force on the surface of developing sleeve 53 at the position corresponding to restricting pole S1 each can be adjusted to a desired value.

[Method of Manufacturing of Magnet Roller]

Figure 9:
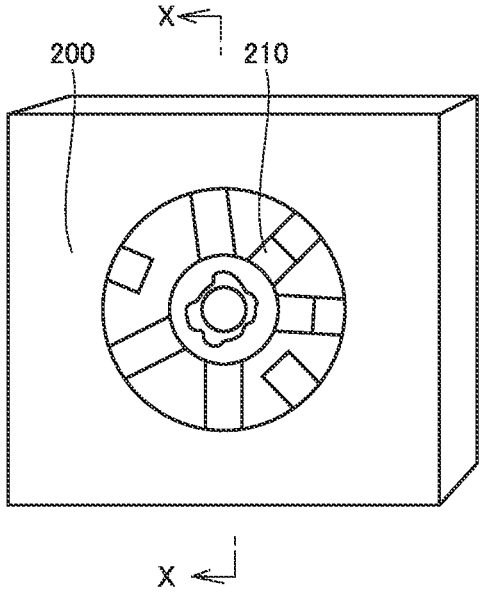
FIG. 9 is a diagram showing a metal mold used when manufacturing the magnet roller according to the embodiment.
Figure 10:
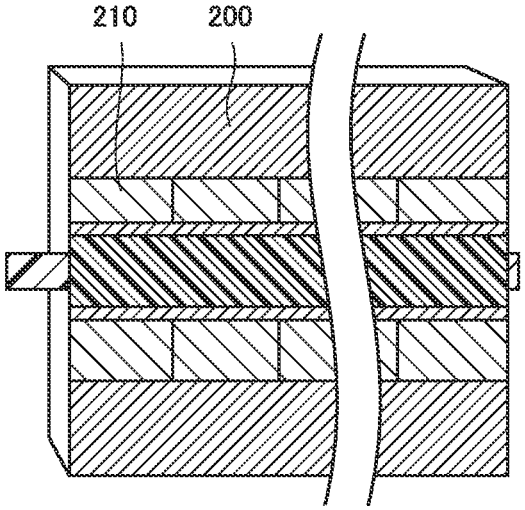
FIG. 10 is a cross-sectional view of the metal mold shown in FIG. 9.

FIG. 9 is a diagram showing a metal mold used when manufacturing the magnet roller according to the embodiment. FIG. 10 is a cross-sectional view of the metal mold shown in FIG. 9. Referring to FIGS. 9 and 10, a method of manufacturing magnet roller 52 according to the embodiment will be hereinafter described.

As shown in FIGS. 9 and 10, when manufacturing magnet roller 52, the cavity inside metal mold 200 is filled with a bonded magnet made of a mixture of magnetic particles and resin, to integrally mold magnet portion 521 and shaft portion 522 by injection molding.

In metal mold 200, a plurality of magnetizing magnets 210 are placed in lines in the axis direction of magnet roller 52, and also these plurality of lines of magnetizing magnets 210 are arranged side by side in the circumferential direction of magnet roller 52. By using such metal mold 200, magnetic field orientation can be performed simultaneously with injection molding. Magnetic field orientation is performed by adjusting (i) the magnetic force of magnetizing magnet 210 and (ii) the distance from magnetizing magnet 210 to the cavity used for molding magnet portion 521. Also, by increasing the distance between the developing sleeve and magnetizing magnet 210, magnetic force variations (ripple) of the magnetic pole in the above-described axis direction can be reduced.

Furthermore, as compared with the cylindrical-shaped magnet portion in a comparative embodiment described later, the outer shape of magnet portion 521 according to the embodiment is formed to have irregular recesses instead of being circular, so that the amount of the bonded magnet used during molding can be significantly reduced. Thereby, the manufacturing cost of magnet roller 52 can be reduced.

The embodiment has been described with reference to an example of the case where magnet portion 521 and shaft portion 522 are integrally molded, but is not limited thereto. For example, when a cutout portion or a protruding portion for setting the direction of magnet roller 52 is formed, it may be structurally difficult to integrally mold magnet portion 521 and shaft portion 522. In such a case, cylindrical-shaped magnet portion 521 may be first molded, into which a metal shaft may then be inserted.

As described above, magnet roller 52 according to the embodiment is configured such that (i) the magnetic force on the surface of developing sleeve 53 at the position corresponding to each of the plurality of magnetic poles of magnet portion 521 is determined by the distance from each of the plurality of magnetic poles to developing sleeve 53 in the radial direction of developing sleeve 53 and the magnitude of the magnetic force in each of the plurality of magnetic poles, and (ii) the distances from the plurality of magnetic poles to the developing sleeve in the radial direction of the developing sleeve are different. Accordingly, even when at least one of the plurality of magnetic poles is magnetized in the vicinity of the saturated magnetization force, the distance from this at least one of the plurality of magnetic poles to developing sleeve 53 can be adjusted such that the magnetic force on the surface of developing sleeve 53 is set at a desired value.

By magnetizing at least one of the magnetic poles of magnet portion 521 in the vicinity of the saturated magnetization force, variations in magnetic force of this at least one of the magnetic poles of magnet portion 521 can be suppressed even when variations occur in the magnetic force of the magnetizing magnet. Consequently, variations in magnetic force on the surface of developing sleeve 53 can also be suppressed.

Developing roller 60 including magnet roller 52, developing device 50 and image forming apparatus 100 can also achieve the effect similar to that achieved by magnet roller 52 according to the embodiment.

Comparative Embodiment

Figure 11:
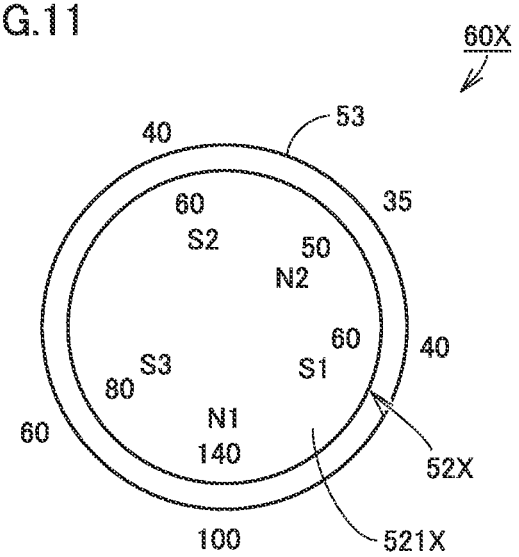
FIG. 11 is a diagram showing: magnetic force in each magnetic pole of a magnet portion according to a comparative embodiment; and magnetic force on the developing sleeve at the position corresponding to each magnetic pole.

FIG. 11 is a diagram showing: magnetic force in each magnetic pole of a magnet portion according to a comparative embodiment; and magnetic force on the developing sleeve at the position corresponding to each magnetic pole. Referring to FIG. 11, a developing roller 60X according to the comparative embodiment will be described.

As shown in FIG. 11, developing roller 60X according to the comparative embodiment is different in shape of a magnet portion 521X in a magnet roller 52X from developing roller 60 according to the embodiment. Other configurations are almost the same.

Magnet portion 521X has a cylindrical shape. Magnet portion 521X has a cross section that is orthogonal to the axis direction of magnet roller 52X. The cross section of magnet portion 521X has a circular shape. The distances from a plurality of magnetic poles of magnet portion 521X to developing sleeve 53 are fixed. Accordingly, the magnetic force on the surface of developing sleeve 53 at the position corresponding to each of the plurality of magnetic poles is determined by the magnitude of the magnetic force in each of the plurality of magnetic poles.

Pumping pole S2 is magnetized such that the magnetic force is approximately 60 mT in pumping pole S2. In this case, the magnetic force on the surface of developing sleeve 53 at the position corresponding to pumping pole S2 becomes approximately 40 mT.

Conveying pole N2 is magnetized such that the magnetic force is approximately 50 mT in conveying pole N2. In this case, the magnetic force on the surface of developing sleeve 53 at the position corresponding to conveying pole N2 becomes approximately 35 mT.

Restricting pole S1 is magnetized such that the magnetic force is 60 mT in restricting pole S1. In this case, the magnetic force on the surface of developing sleeve 53 at the position corresponding to restricting pole S1 becomes approximately 40 mT.

Developing pole N1 is magnetized such that the magnetic force is approximately 140 mT in developing pole N1. In this case, the magnetic force on the surface of developing sleeve 53 at the position corresponding to developing pole N1 becomes approximately 100 mT.

Peeling pole S3 is magnetized such that the magnetic force is 80 mT in peeling pole S3. In this case, the magnetic force on the surface of developing sleeve 53 at the position corresponding to peeling pole S3 becomes approximately 60 mT.

Figure 12:
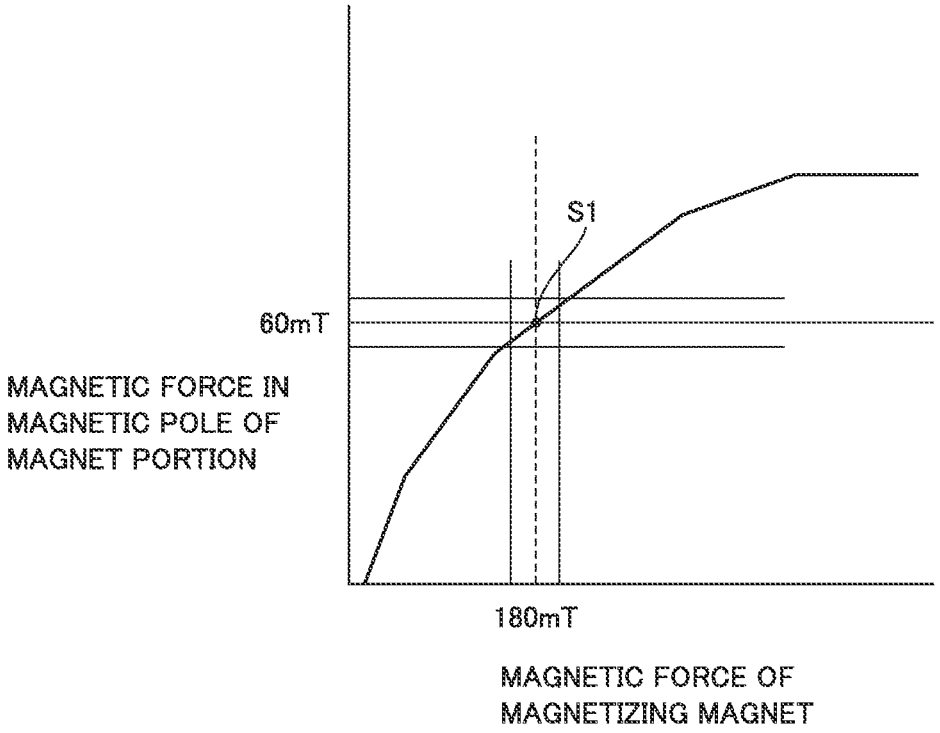
FIG. 12 is a diagram showing magnetic force of a restricting pole according to the comparative embodiment and magnetic force of a magnetizing magnet for magnetizing a restricting pole while illustrating the relation between the magnetic force of the magnetizing magnet and the magnetic force in each magnetic pole of the magnet portion magnetized by the magnetizing magnet.

FIG. 12 is a diagram showing magnetic force of a restricting pole according to the comparative embodiment and magnetic force of a magnetizing magnet for magnetizing the restricting pole while illustrating the relation between the magnetic force of the magnetizing magnet and the magnetic force in each magnetic pole of the magnet portion magnetized by the magnetizing magnet.

As shown in FIG. 12, the relation between the magnetic force of the magnetizing magnet according to the comparative embodiment and the magnetic force in each magnetic pole of the magnet portion magnetized by the magnetizing magnet is almost the same as that in the embodiment. In the comparative embodiment, however, restricting pole S1 is magnetized by the magnetizing magnet having a magnetic force of approximately 180 mT. Restricting pole S1 is magnetized so as to exhibit not the saturated magnetic force but the magnetic force equivalent to approximately the half of the saturated magnetic force.

Accordingly, when variations occur in the magnetic force of the magnetizing magnet, variations also occur in the magnetic force of magnetized restricting pole S1. Consequently, the magnetic force on the surface of developing sleeve 53 at the position corresponding to restricting pole S1 may also largely deviates from the desired target value.

(Verification Experiment)

FIG. 13 is a diagram showing results of Verification Experiment 1 conducted in order to verify the effect of the embodiment. Referring to FIG. 13, Verification Experiment 1 conducted in order to verify the effect of the embodiment will be hereinafter described.

As shown in FIG. 13, in Verification Experiment 1, developing rollers according to Example 1 and Comparative Examples 1 and 2 were prepared. Then, the magnetic force on the surface of the developing sleeve at the position corresponding to each magnetic pole was measured using a gauss meter. The value of the measured magnetic force was compared with the specification value of the magnetic force on the surface of the developing sleeve.

As a developing roller according to Example 1, a developing roller including magnet roller 52 according to the embodiment was prepared. As a developing roller according to each of Comparative Examples 1 and 2, a developing roller including magnet roller 52X according to the comparative embodiment was prepared.

The specification value of the magnetic force on the surface of the developing sleeve at the position corresponding to developing pole N1 is 100 (a reference value)±5 mT. The specification value of the magnetic force on the surface of the developing sleeve at the position corresponding to conveying pole N2 is 35 (a reference value)±5 mT. The specification value of the magnetic force on the surface of the developing sleeve at the position corresponding to restricting pole S1 is −40 (a reference value)±5 mT. The specification value of the magnetic force on the surface of the developing sleeve at the position corresponding to pumping pole S2 is −40 (a reference value)±5 mT. The specification value of the magnetic force on the surface of the developing sleeve at the position corresponding to peeling pole S3 is −60 (a reference value)±5 mT.

In the developing roller according to Example 1, the magnetic force on the surface of the developing sleeve at the position corresponding to each of the magnetic poles is relatively close to a corresponding one of the reference values as compared with those in Comparative Examples 1 and 2.

Based on this result, it was confirmed that the variations in magnetic force on the surface of the developing sleeve at the position corresponding to each magnetic pole can be suppressed by employing magnet roller 52 according to the embodiment.

Figure 15:
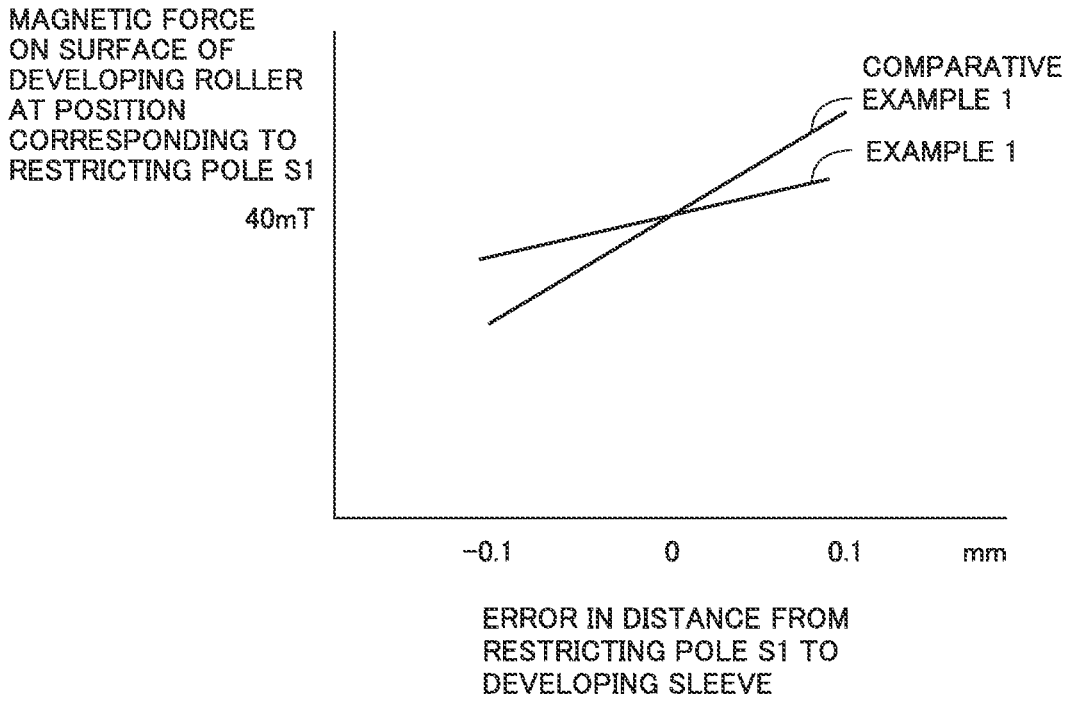
FIG. 15 is a diagram showing results of Verification Experiment 3 conducted in order to verify the effect of the embodiment.

FIG. 14 is a diagram showing results of Verification Experiment 2 conducted in order to verify the effect of the embodiment. FIG. 15 is a diagram showing results of Verification Experiment 3 conducted in order to verify the effect of the embodiment. Referring to FIGS. 14 and 15, Verification Experiments 2 and 3 conducted in order to verify the effect of the embodiment will be hereinafter described.

As shown in FIGS. 14 and 15, developing rollers according to Example 1 and Comparative Example 1 were prepared also in Verification Experiments 2 and 3. In Example 1, a developing roller including magnet roller 52 according to the embodiment was prepared as in Verification Experiment 1. In Comparative Example 1, a developing roller including magnet roller 52X according to the comparative embodiment was prepared as in Verification Experiment 1.

As shown in FIG. 14, in Verification Experiment 2, the developing rollers according to Example 1 and Comparative Example 1 were examined to measure, along the axis direction, the magnetic force on the surface of the developing sleeve at the position corresponding to restricting pole S1.

In the developing roller according to Comparative Example 1, the distance from restricting pole S1 to developing sleeve 53 is shorter than that in Example 1. Accordingly, Comparative Example 1 is more likely to be influenced by the magnetic force variations in the plurality of magnetizing magnets 210 arranged in the axis direction. Thus, a reduction of magnetic force was observed in the portion corresponding to a joint of magnetizing magnet 210.

On the other hand, in the developing roller according to Example 1, the distance from restricting pole S1 to developing sleeve 53 is longer than that in Comparative Example 1. Accordingly, Example 1 is less likely to be influenced by the magnetic force variations in the plurality of magnetizing magnets 210 arranged in the axis direction. Thus, a reduction of magnetic force was suppressed in the portion corresponding to a joint of magnetizing magnet 210.

As shown in FIG. 15, in Verification Experiment 3, the developing rollers according to Example 1 and Comparative Example 1 were examined to check the magnetic force variations on the surface of the developing sleeve at the position corresponding to restricting pole S1 that were caused by the variations in distance from restricting pole S1 to the developing sleeve.

In the developing roller according to Comparative Example 1, the distance from restricting pole S1 to developing sleeve 53 is shorter than that in Example 1. Accordingly, in Comparative Example 1, the magnetic force on the surface of the developing sleeve was significantly changed by the variations in distance from restricting pole S1 to the developing sleeve.

On the other hand, in the developing roller according to Example 1, the distance from restricting pole S1 to developing sleeve 53 is longer than that in Comparative Example 1. Accordingly, in Example 1, the magnetic force variations on the surface of the developing sleeve that were caused by the variations in distance from restricting pole S1 to the developing sleeve could be suppressed.

A magnet roller of the present disclosure as described above is disposed inside a developing sleeve formed in a cylindrical shape. The magnet roller of the present disclosure includes a magnet portion for generating magnetic force such that a plurality of peaks are formed in a magnetic force distribution in a circumferential direction of the magnet roller. The magnet portion includes a plurality of magnetic poles arranged in the circumferential direction so as to form the plurality of peaks. The magnet portion has a cross section that is orthogonal to an axis direction of the magnet roller. The cross section has a shape formed to include a portion in which a distance from an axial center of the magnet portion to an outer edge of the magnet portion changes continuously in the circumferential direction. Magnetic force on a surface of the developing sleeve at a position corresponding to each of the plurality of magnetic poles is determined by (i) a distance from each of the plurality of magnetic poles to the developing sleeve in a radial direction of the developing sleeve and (ii) a magnitude of magnetic force in each of the plurality of magnetic poles. Distances from the plurality of magnetic poles to the developing sleeve in the radial direction of the developing sleeve are different.

In the magnet roller of the present disclosure, the plurality of magnetic poles may include a main magnetic pole having maximum magnetic force. In this case, it is preferable that the main magnetic pole has magnetic force that is 80% or higher of saturated magnetic force obtained when the main magnetic pole is magnetized until the magnetic force is saturated.

In the magnet roller of the present disclosure, the plurality of magnetic poles may include: a developing pole for causing a developer carried by the developing sleeve to rise to form a magnetic brush; and a restricting pole for restricting a layer thickness of the developer carried by the developing sleeve. In this case, it is preferable that the developing pole has magnetic force that is 80% or higher of saturated magnetic force obtained when the developing pole is magnetized until the magnetic force is saturated. Also, it is preferable that the restricting pole has magnetic force that is 80% or higher of saturated magnetic force obtained when the restricting pole is magnetized until the magnetic force is saturated.

In the magnet roller of the present disclosure, the plurality of magnetic poles may include a developing pole for causing a developer carried by the developing sleeve to rise to form a magnetic brush. In this case, it is preferable that, in the shape of the cross section of the magnet portion, a portion of the outer edge that corresponds to the developing pole includes a portion that is located at a maximum distance from the axial center of the magnet portion.

In the magnet roller of the present disclosure, the plurality of magnetic poles may include a peeling pole for peeling off a developer carried by the developing sleeve. In this case, in the shape of the cross section of the magnet portion, a portion of the outer edge that corresponds to the peeling pole may include a straight portion.

In the magnet roller of the present disclosure, the magnet portion may be integrally molded.

The magnet roller of the present disclosure may further include a shaft portion protruding from the magnet portion in the axis direction. In this case, the shaft portion and the magnet portion may be integrally molded.

In the magnet roller of the present disclosure, it is preferable that the shape of the cross section of the magnet portion is uniform in the axis direction.

A developing roller of the present disclosure includes: the magnet roller; and the developing sleeve.

A developing device of the present disclosure includes: the developing roller; and a developer restriction member configured to restrict an amount of a developer carried by the developing roller.

An image forming apparatus of the present disclosure includes: the developing device; and a transfer unit configured to transfer a toner image developed by the developing device onto a recording medium.

Although embodiments of the present invention have been described and illustrated in detail, the disclosed embodiments are made for purposes of illustration and example only and not limitation. The scope of the present invention should be interpreted by terms of the appended claims.

What is claimed is:

1. A magnet roller disposed inside a developing sleeve formed in a cylindrical shape, the magnet roller comprising:

a magnet portion for generating magnetic force such that a plurality of peaks are formed in a magnetic force distribution in a circumferential direction of the magnet roller, the magnet portion including a plurality of magnetic poles that are arranged in the circumferential direction so as to form the plurality of peaks, the magnet portion having a cross section that is orthogonal to an axis direction of the magnet roller, the cross section having a shape that is formed to include a portion in which a distance from an axial center of the magnet portion to an outer edge of the magnet portion changes continuously in the circumferential direction, wherein magnetic force on a surface of the developing sleeve at a position corresponding to each of the plurality of magnetic poles is determined by (i) a distance from each of the plurality of magnetic poles to the developing sleeve in a radial direction of the developing sleeve, and (ii) a magnitude of magnetic force in each of the plurality of magnetic poles, distances from the plurality of magnetic poles to the developing sleeve in the radial direction of the developing sleeve are different, and a radius of the magnet portion between each pair of two adjacent magnetic poles in a circumferential direction is less than a radius of each of the two adjacent magnetic poles, whereby a cross section of the magnet portion has a recess between the each pair of two adjacent magnetic poles.

2. The magnet roller according to claim 1, wherein the plurality of magnetic poles include a main magnetic pole having maximum magnetic force, and the main magnetic pole has magnetic force that is 80% or higher of saturated magnetic force obtained when the main magnetic pole is magnetized until the magnetic force is saturated.

3. The magnet roller according to claim 1, wherein the plurality of magnetic poles include a developing pole for causing a developer carried by the developing sleeve to rise to form a magnetic brush, and a restricting pole for restricting a layer thickness of the developer carried by the developing sleeve, the developing pole has magnetic force that is 80% or higher of saturated magnetic force obtained when the developing pole is magnetized until the magnetic force is saturated, and the restricting pole has magnetic force that is 80% or higher of saturated magnetic force obtained when the restricting pole is magnetized until the magnetic force is saturated.

4. The magnet roller according to claim 3, wherein the magnetic force of the developing pole is the same as the magnetic force of the restricting pole, and a distance between the developing pole and the developing sleeve is smaller than a distance between the restricting pole and the developing sleeve.

5. The magnet roller according to claim 3, wherein the developing pole and the restricting pole each correspond to a main magnetic pole having a maximum magnetic force in the magnet roller.

6. The magnet roller according to claim 3, wherein the plurality of magnetic poles include a peeling pole for peeling off the developer carried by the developing sleeve, and in the shape of the cross section of the magnet portion, a portion of the outer edge that corresponds to the peeling pole includes a straight portion.

7. The magnet roller according to claim 6, wherein the plurality of magnetic poles further includes a pumping pole for causing charged developer to be attracted to and adhered to the developing sleeve and a conveying pole for causing the developer adhered to the developing sleeve to be conveyed toward the restricting pole.

8. The magnet roller according to claim 7, wherein the plurality of magnetic poles are arranged sequentially in the circumferential direction in a sequential order of the pumping pole, the conveying pole, the restricting pole, the developing pole, and the peeling pole.

9. The magnet roller according to claim 1, wherein the plurality of magnetic poles include a developing pole for causing a developer carried by the developing sleeve to rise to form a magnetic brush, and in the shape of the cross section of the magnet portion, a portion of the outer edge that corresponds to the developing pole includes a portion that is located at a maximum distance from the axial center of the magnet portion.

10. The magnet roller according to claim 1, wherein the plurality of magnetic poles include a peeling pole for peeling off a developer carried by the developing sleeve, and in the shape of the cross section of the magnet portion, a portion of the outer edge that corresponds to the peeling pole includes a straight portion.

11. The magnet roller according to claim 1, wherein the magnet portion is integrally molded.

12. The magnet roller according to claim 1, further comprising a shaft portion protruding from the magnet portion in the axis direction, wherein the shaft portion and the magnet portion are integrally molded.

13. The magnet roller according to claim 1, wherein the shape of the cross section of the magnet portion is uniform in the axis direction.

14. A developing roller comprising:

the magnet roller according to claim 1; and the developing sleeve.

15. A developing device comprising:

the developing roller according to claim 14; and a developer restriction member configured to restrict an amount of a developer carried by the developing roller.

16. An image forming apparatus comprising:

the developing device according to claim 15; and a transfer unit configured to transfer a toner image developed by the developing device onto a recording medium.

17. The magnet roller according to claim 1, wherein the plurality of magnetic poles includes five poles.

18. The magnet roller according to claim 17, wherein the magnetic force on the surface of the developing sleeve at positions corresponding to the five poles being 100±5 mT, −40±5 mT, 35±5 mT, −40±5 mT, and −60±5 mT, arranged sequentially in the circumferential direction.

* * * * *